US005851109A

United States Patent [19]

Reynolds

[11] Patent Number: 5,851,109

[45] Date of Patent: Dec. 22, 1998

[54] SPACER AND SHIM ASSEMBLY FOR FLUID POWERED DIAPHRAGM PUMPS

[75] Inventor: Steven M. Reynolds, Lucas, Ohio

[73] Assignee: Warren Rupp, Inc., Mansfield, Ohio

[21] Appl. No.: 786,904

[22] Filed: Jan. 22, 1997

[51] Int. Cl.[6] ..... F04B 43/06

[52] U.S. Cl. ..... 417/395; 285/408; 285/910

[58] Field of Search ..... 417/393; 285/408, 285/910, 368; 277/180, 207 A, 235 R

[56] References Cited

U.S. PATENT DOCUMENTS

| | | | |
|---|---|---|---|
| 3,158,380 | 11/1964 | Carrell et al. | 277/180 |
| 3,462,161 | 8/1969 | Daubenberger et al. | 277/180 |
| 3,507,506 | 4/1970 | Tillman, III | 277/235 |
| 4,705,458 | 11/1987 | St. Laurent et al. | 417/393 |
| 4,776,600 | 10/1988 | Kohn | 277/180 |
| 4,998,740 | 3/1991 | Tellier | 277/180 |
| 5,108,270 | 4/1992 | Kozumplik, Jr. | 417/393 |
| 5,277,455 | 1/1994 | Graves et al. | 285/910 |
| 5,316,320 | 5/1994 | Breaker | 277/207 A |
| 5,333,919 | 8/1994 | Nerenberg | 285/910 |
| 5,427,386 | 6/1995 | Breaker | 285/368 |
| 5,518,257 | 5/1996 | Breaker | 277/180 |
| 5,564,715 | 10/1996 | Wallace | 277/180 |
| 5,564,911 | 10/1996 | Santa | 417/393 |

FOREIGN PATENT DOCUMENTS

| | | | |
|---|---|---|---|
| 4211076 A1 | 10/1993 | Germany | 277/207 A |

*Primary Examiner*—Charles G. Freay
*Attorney, Agent, or Firm*—Hill & Simpson

[57] ABSTRACT

A three-piece combination spacer and shim assembly is provided for an air operated diaphragm pump. The spacer/shim assembly is disposed between adjacent parts of the manifold assemblies of the pumps to alleviate dimensional stack up and misalignment problems associated with the manifold assemblies of air operated diaphragm pumps. The assemblies provide a seal between the spacer component and the adjoining flanges of the manifold components.

14 Claims, 3 Drawing Sheets

SPACER AND SHIM ASSEMBLY FOR FLUID POWERED DIAPHRAGM PUMPS

FIELD OF THE INVENTION

The present invention is directed toward fluid powered diaphragm pumps and, more specifically, to spacer and/or shim assemblies for fluid powered diaphragm pumps. Still more specifically, the present invention is directed toward an improved combination spacer and shim assembly for attachment between two components of a fluid powered diaphragm pump.

BACKGROUND OF THE INVENTION

Air operated diaphragm pumps are known. One particularly successful design is illustrated in FIG. 1 which is a schematic illustration of a prior art diaphragm pump sold under the SANDPIPER® trademark by Warren Rupp, Inc. of Mansfield, Ohio. The pump 10 as illustrated in FIG. 1 includes two pumping chambers shown at 11 and 12. Flexible diaphragms 13, 14 divide the pumping sections, or pumping chambers 11, 12, from the air driving section or air driving chambers shown at 15, 16. The two diaphragms 13, 14 are connected by a diaphragm rod 17.

As air enters the chamber 16, it drives the diaphragm 14 outward on a discharge or pump stroke. This action forces the liquid out of the chamber 12, through the check valve 18, through the manifold components 21, 22 and out the discharge outlet 23 as shown by the arrows 24, 25. As the diaphragm 14 is pushing fluid out through the discharge outlet 23, the diaphragm rod 17 is pulling the diaphragm 13 inward on a suction stroke causing the chamber 11 to fill with fluid which enters from the inlet port 26. Fluid passes through the manifold components 27, 28, through the check valve 31 and into the chamber 11 as indicated by the arrows 32, 33.

At the end of each stroke, the air distribution valve 34 automatically shifts, reversing the entire sequence. The check valve 35 prevents fluid that is being pumped from the chamber 12 and out through the outlet 23 from entering the chamber 11. Similarly, when fluid is being pumped from the chamber 11, through the check valve 35, through the manifold components 36 and 22 before exiting through the discharge outlet 23, the check valve 18 prevents that fluid from being pumped into the chamber 12. The check valves 31 and 37 both prevent fluid that is being pumped from the chambers 11, 12 respectively from entering the inlet manifold components shown at 28, 27 and 38.

The pump 10 illustrated in FIG. 1 is typically customized depending upon the specific application. Specifically, the diaphragms 13, 14 are commonly interchanged for different diaphragms. The interchangeability of the diaphragms 13, 14 enhances the flexibility of the pump 10. However, when the diaphragms 13, 14 are changed, the diaphragm thickness can also change. Any change in the thickness of the diaphragms 13, 14 effects the connection of the outlet manifold components 36, 22 and 21 as well as the inlet manifold components 28, 27 and 38. As a result, the manifold components shown at 36, 22, 21 and 28, 27, 38 do not line up for all diaphragm thicknesses resulting in a "dimensional stack up problem".

Another cause of this dimensional stack up problem is the shrinkage of plastic components after molding. The diaphragms 13, 14 are almost inevitably fabricated from plastic material which may shrink after molding. Further, cast or molded parts that may include the manifolds, elbows, chambers and intermediate housings may also suffer from shrinkage. To date, there is no accurate method of calculating the shrink rate of most plastic parts after molding or metallic molded or cast parts. While some of the discrepancy can be corrected when a metal part is machined, plastic parts are not machined and therefore this technique is not available.

To address the above-referenced dimensional stack up problems, pump manufacturers have resorted to varying the thickness of pump centers to accommodate the various stack up dimensions. Pump manufacturers have also resorted to shim stock of varying thicknesses installed behind the diaphragms to widen or shorten the assembly stack up as required. However, the above-referenced solutions are difficult to employ and must be modified for each particular pump. Hence, the above-referenced solutions require a very high level of expertise during the assembly of the pump 10.

Also, pump manufacturers have unsuccessfully resorted to slotting the holes that accommodate the bolts 40 used to connect the manifold components 36, 21, 38 and 28 to the housing components 11 *a*, 12*a* together to accommodate for any misalignment. This solution can result in the misalignment of the conduits or passageways or seals disposed between the flanges.

In order to simplify the assembly of air operated diaphragm pumps and diaphragm pumps in general, there is a need for an improved solution to the dimensional stack up problems of these pumps. Such a solution should simplify the assembly and design of diaphragm pumps.

SUMMARY OF THE INVENTION

The present invention provides a solution to the above-referenced dimensional stack up problems associated with diaphragm pumps by providing an improved combination spacer and shim assembly which would be made available in one or more common thicknesses to accommodate the most common dimensional stack up problems. The combination spacer and shim assemblies would be attached between two components of a manifold assembly of a diaphragm pump. The assembly includes an annular spacer plate with an outer periphery for attachment between two components of a manifold assembly. The first side of the spacer plate includes a first annular recessed area at an inner periphery of the spacer plate for accommodating a first annular seal. The second side of the spacer plate includes a second annular recessed area at an inner periphery of the spacer plate for accommodating a second annular seal. The first seal provides a sealing engagement between the spacer plate and one manifold component while the second seal provides a sealing engagement between the spacer plate and the second manifold component.

In an embodiment, the inner periphery of the spacer plate further includes a central wall disposed between the first and second recessed areas, or between the first and second annular seals.

In an embodiment, the spacer plate is provided in two primary thicknesses to address the two common dimensional stack up problems experienced during the assembly of air operated diaphragm pumps.

In an embodiment, the spacer plate is fabricated from an injection molded material.

In an embodiment, the first and second annular seals are fabricated from an elastomer material.

In an embodiment, the annular seal includes an outwardly extending lip for enhancing the seal between the annular spacer plate and the manifold component.

In an embodiment, the annular seal includes two spaced-apart outwardly extending lips for enhancing the seal between the spacer plate and the manifold component.

In an embodiment, the inner most peripheries of the first and second sealingly engage one another and prevent fluid that is being pumped through the manifold from coming into contact with the annular spacer plate.

The present invention also provides a method for manufacturing improved manifold assemblies for use in air operated diaphragm pumps. The method includes the steps of providing a central conduit section which includes first and second opposing ends for attachment to first and second elbow conduit sections of the manifold assembly as well as a central port for communication with either an input conduit or a discharge conduit. Combination spacer and shim assemblies as described above are inserted between the first opposing end of the central conduit and an inner end of a first elbow conduit as well as between the second opposing end of the central conduit and an inner end of the second elbow conduit. The combination spacer and shim assemblies provide a seal between the opposing ends of the central conduit and the inner ends of the elbow conduits as well as the needed spacer/shim function described below.

The present invention also provides an improved air operated diaphragm pump incorporating the combination spacer and shim assembly of the present invention.

Other objects and advantages of the present invention will become apparent upon reading the following detailed description of the invention and appended claims, and upon reference to the accompanying drawings.

BRIEF DESCRIPTION OF THE DRAWINGS

The drawings show two exemplary embodiments of the combination spacer and shim assembly of the present invention. Specifically.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Returning to FIG. 1, as noted above, dimensional stack up problems commonly associated with a pump 10 as illustrated in FIG. 1 occurs between the manifold components 36, 22 or 22, 21, or 28, 27 or 27, 38. The stack up problems are caused primarily by a change in the thicknesses of the diaphragms 13, 14 or shrinkage of other components as discussed above. Of course, other plastic or polymer components contained within the pump 10 can also contribute to the dimensional stack up problems.

Figure 1:
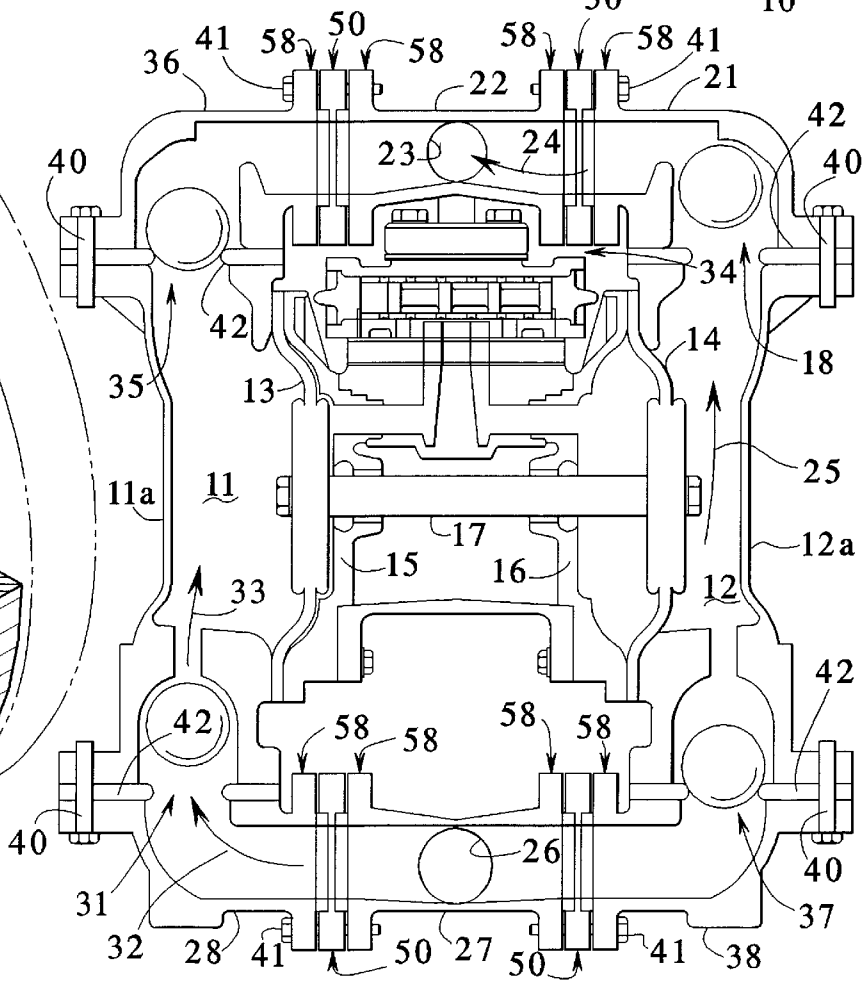
FIG. 1 is a schematic illustration of a prior art operated diaphragm pump.

To alleviate the dimensional stack up and misalignment problems associated with the manifolds, combination spacer and shim assemblies 50 are inserted between the known manifold components 36–22, 22–21, 28–27 and 27–38 as shown in FIG. 1.

Figure 2:
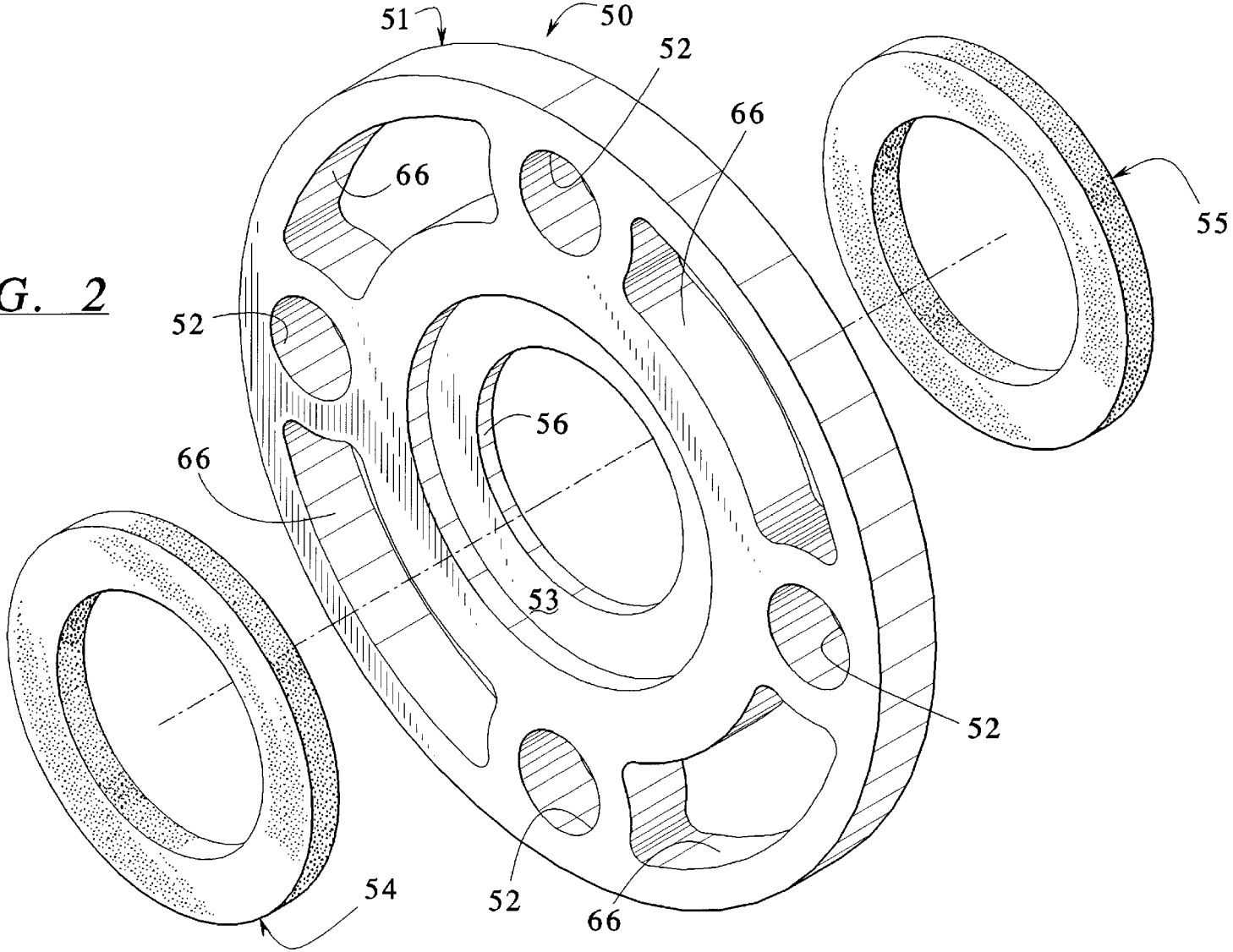
FIG. 2 is an exploded view of a combination spacer and shim assembly made in accordance with the present invention.

A perspective illustration of the assembly 50 is provided in FIG. 2. The assembly 50 includes an annular spacer plate 51 which includes a plurality of bolt holes 52 disposed at the outer periphery of the plate 51. The bolt holes 52 accommodate the bolts 41 (see FIG. 1) that are used to connect the manifold components together. An annular recessed area is shown at 53 which accommodates the annular seal shown at 54. A similar annular recessed area is disposed on the other side of the annular plate 51 for accommodating the annular seal shown at 55.

Figure 3:
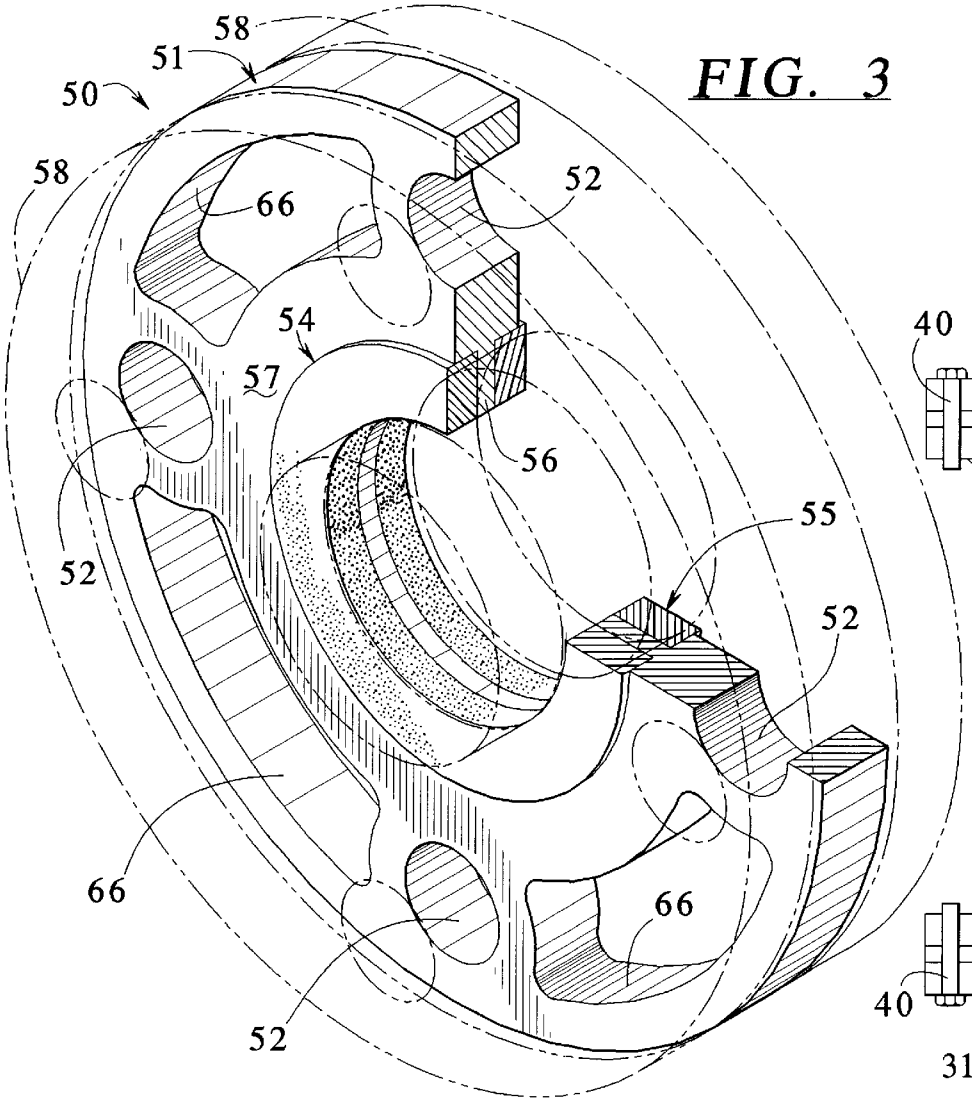
FIG. 3 is a perspective view of the combination spacer and shim assembly shown in FIG. 2 disposed between flanges of a manifold assembly which are shown in phantom.
Figure 4:
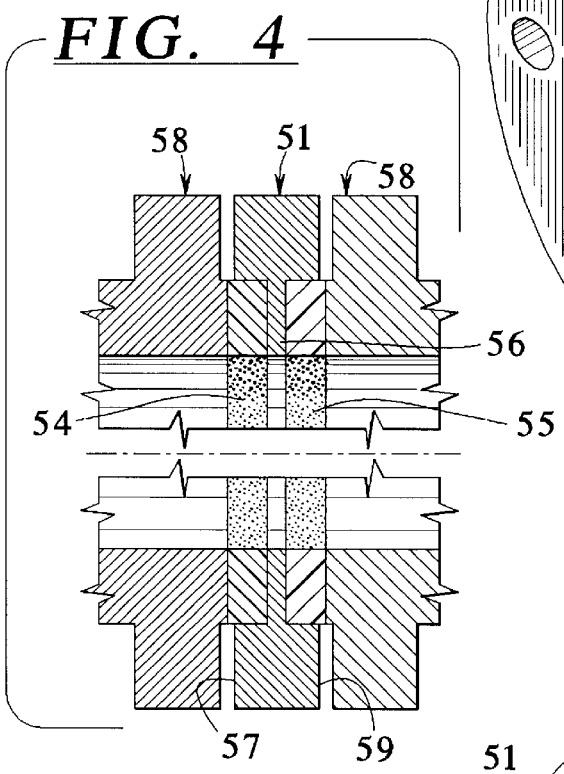
FIG. 4 is a sectional view of the combination spacer and shim assembly shown in FIG. 1 as disposed between two components of a manifold assembly.
Figure 5:
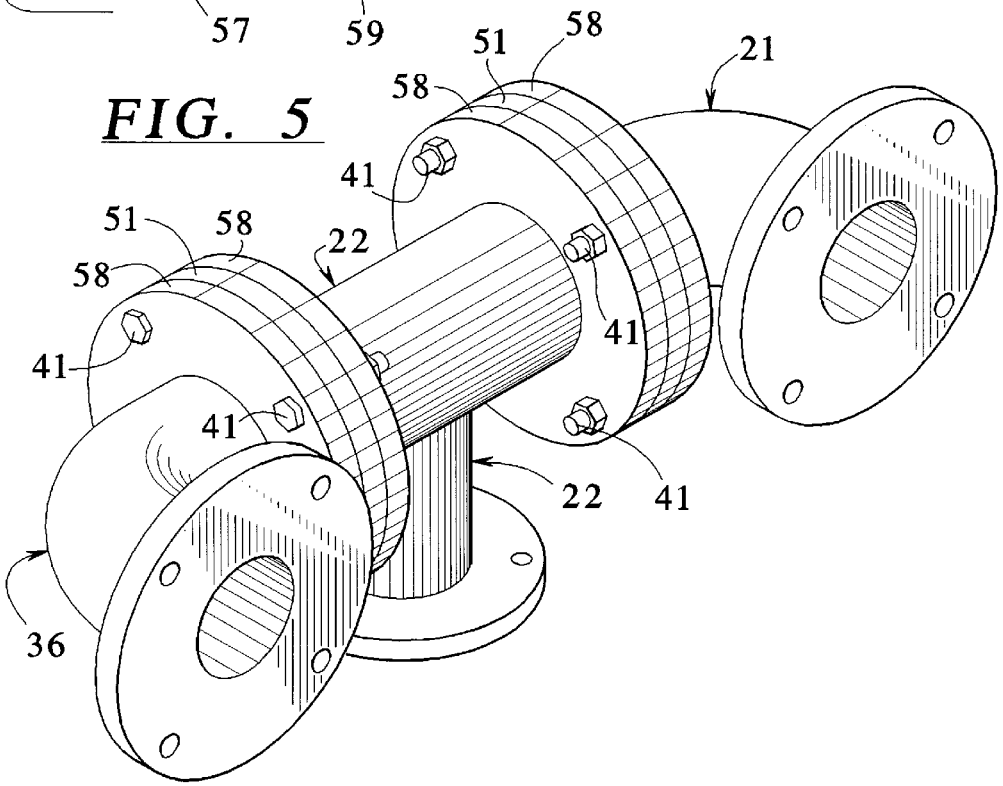
FIG. 5 is a perspective view of a manifold assembly of a diaphragm pump.

As illustrated in FIG. 3, the annular spacer 51 is incorporated into the pump 10 by disposing it between two flanges shown at 58 in phantom. The flanges are also indicated generally at 58 in FIG. 1. The flanges accommodate the seals 54, 55 in the annular recesses disposed at the inner periphery of the annular plate 51. A central wall 56 is disposed between the annular recesses. In the preferred embodiment illustrated in FIG. 3, the seal 55 extends outward beyond the surface 57 of the annular spacer 51. Similarly, as better illustrated in FIG. 4, the seal 55 extends outward beyond the surface 59 of the annular spacer plate 51. The extension of the seals 54, 55 beyond the surfaces or faces 57, 59 of the annular spacer 51 ensure that the seals 54, 55 will be compressed and the annular spacer plate 51 is bolted between the flanges 58 as illustrated in FIG. 5. In addition to the bolts shown at 41, other fastening means for attaching a central component 22 of a manifold to adjoining elbow components 36 and 21 may be provided.

Figure 6:
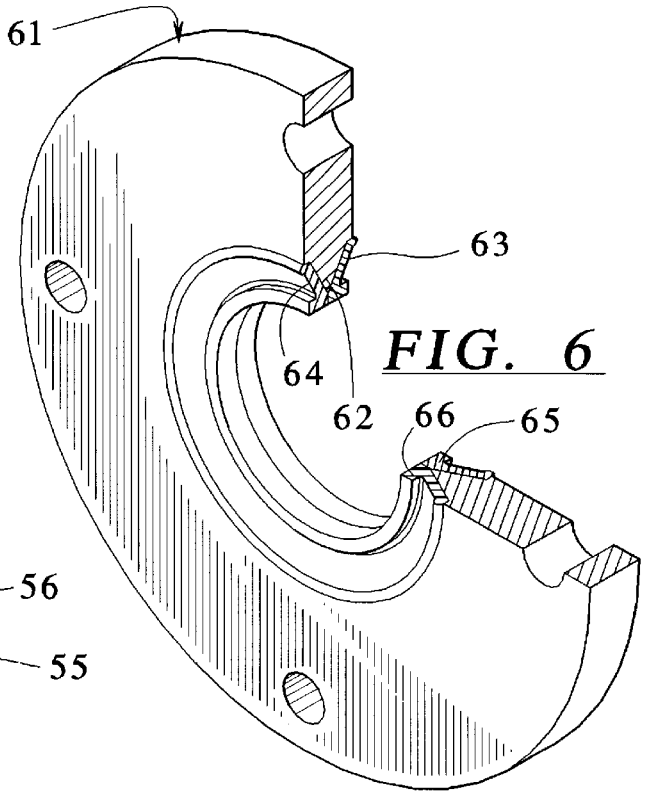
FIG. 6 is a perspective view of a second embodiment of a combination spacer and shim assembly made in accordance with the present invention.

In an alternative embodiment illustrated in FIG. 6, the annular spacer plate 61 includes a tapered wall 62 at its inner periphery. The tapered wall 62 provides two slanted surfaces 63, 64 for accommodating two outwardly protruding lips 65, 68. The seals engage each other at a point disposed radially inside from the end of the tapered wall 62. When the annular spacer plate 61 is clamped between two flanges, like those shown at 58 in FIGS. 4 and 5, the outwardly protruding lips 68, 65 are pressed together to prevent any fluid that is being transported through the manifold from coming into contact with the spacer plate 61. Accordingly, the spacer plate 61 need not be fabricated from a material that is resistant to the material being pumped through the manifold. Instead, a less expensive material may be used.

From the above description, it is apparent that the objects of the present invention have been achieved. While only certain embodiments have been set forth, alternative embodiments and various modifications will be apparent from the above description to those skilled in the art. For example, slots like those shown at 68 in FIGS. 2 and 3 may be provided to reduce the amount of material used to fabricate the annular spacer plate 51. Further, the annular spacer plate may be fabricated from a variety of materials, depending upon the chemical or liquid being pumped through the manifold. Preferably, to reduce the cost of manufacturing, the spacer plates 51 and 61 should be made from injection molded materials. In addition, because the seals 54, 55 provide a sealing engagement between the spacer plate 51 and the manifold components, the flanges 58 of the manifold component need not incorporate a seal or an O-ring in the flange face. Hence, the incorporation of the annular spacer plate 51 and seals 54, 55 between the two flange components simplifies the design of the flange component because no seal flanges or O-rings need to be machined or molded into them. As a result, machining costs and/or mold costs are reduced. These and other alternatives are considered equivalents and within the spirit and scope of the present invention.

What is claimed is:

1. A combination spacer and shim assembly for attachment between first and second fluid communicating parts of a pump, the assembly comprising:

an annular spacer plate comprising an outer periphery for attachment between the two fluid communicating parts of the pump assembly, the spacer plate further comprising a first side and a second side, the spacer plate being fabricated from an injection molded material, the first side of the spacer plate comprising a first annular recessed area at an inner periphery thereof for removably accommodating a first annular seal, the second side of the spacer plate comprising a second annular recessed area at an inner periphery thereof for removably accommodating a second annular seal, the first seal providing a sealing engagement between the annular spacer plate and the first fluid communicating part of the pump, the second seal providing a sealing engagement between the annular spacer plate and the second fluid communicating part of the pump, the first and second seals being fabricated from an elastomer material, the first seal removably engaging the annular spacer plate and the first fluid communicating part, the second seal removably engaging the annular spacer plate and the second fluid communicating part, the first seal further comprises at least one outwardly protruding lip, the lip of the first seal engaging the first fluid communicating part of the pump and providing a seal between the annular spacer plate and the first fluid communicating part of the pump.

2. The assembly of claim 1 wherein the inner periphery of the spacer plate further comprises a central wall disposed between the first and second annular recessed areas.

3. The assembly of claim 1 wherein the first seal extends outward beyond the first side of the spacer plate, the second seal extends outward beyond the second side of the space plate.

4. The assembly of claim 1 wherein the second seal further comprises at least one outwardly protruding lip of the second seal, the lip engaging the second fluid communicating part of the pump and providing a seal between the annular spacer plate and the second fluid communicating part of the pump.

5. The assembly of claim 1 wherein the engagement between the first seal and the first fluid communicating part and the engagement between the second seal and the second fluid communicating part prevents fluid being communicated through the first and second fluid communicating parts from coming in contact with the annular spacer plate.

6. An improved air operated diaphragm pump comprising an outer chamber which is connected to a manifold assembly, the manifold assembly comprising first and second fluid communicating parts, the improvement comprising:

a combination spacer and shim assembly for attachment between the first and second fluid communicating parts of the manifold assembly, the combination spacer and shim assembly comprising an annular spacer plate comprising an outer periphery for attachment between the two parts of the pump assembly, the spacer plate further comprising a first side and a second side, the spacer plate being fabricated from an injection molded material, the first side of the spacer plate comprising a first annular recessed area at an inner periphery thereof for removably accommodating an first annular seal, the second side of the spacer plate comprising a second annular recessed area at an inner periphery thereof for removably accommodating a second annular seal, the first seal providing a seal between the annular spacer plate and the first fluid communicating part of the pump, the second seal providing a seal between the annular spacer plate and the second fluid communicating part of the pump, the first and second seals being fabricated from an elastomer material, the first seal removably engaging the annular spacer plate and the first fluid communicating part, the second seal removably engaging the annular spacer plate and the second fluid communicating part, the first seal further comprises at least one outwardly protruding lip, the lip of the first seal engaging the first fluid communicating part of the pump and providing a seal between the annular spacer plate and the first fluid communicating part of the pump.

7. The pump of claim 6 wherein the inner periphery of the spacer plate further comprises a central wall disposed between the first and second annular recessed areas.

8. The assembly of claim 6 wherein the first seal extending outward beyond the first side of the spacer plate, the second seal extending outward beyond the second side of the spacer plate.

9. The pump of claim 6 wherein the second seal further comprises at least one outwardly protruding lip, the lip of the second seal engaging the second fluid communicating part of the pump and providing a seal between the annular spacer plate and the second fluid communicating part of the pump.

10. The pump of claim 9 wherein the engagement between the first seal and the first fluid communicating part and the engagement between the second seal and the second fluid communicating part prevents fluid being communicated through the first and second fluid communicating parts from coming in contact with the annular spacer plate.

11. An improved air operated diaphragm pump for pumping fluid comprising an outer chamber which is connected to a manifold assembly, the manifold assembly comprising first and second fluid communicating parts, the improvement comprising:

a combination spacer and shim assembly for attachment between the first and second fluid communicating parts of the manifold assembly, the combination spacer and shim assembly comprising an annular spacer plate comprising an outer periphery for attachment between the two parts of the pump assembly, the spacer plate further comprising a first side and a second side, the annular spacer plate further comprising an inner periphery, the first side of the spacer plate comprising a first annular recessed area at an inner periphery thereof for removably accommodating an first annular seal, the second side of the spacer plate comprising a second annular recessed area at an inner periphery thereof for removably accommodating a second annular seal, the first annular seal comprising an inner periphery disposed radially inward of the inner periphery of the annular spacer plate, the second annular seal comprising an inner periphery disposed radially inward of the inner periphery of the annular spacer plate and in matching registry with the inner periphery of the first annular seal, the first seal providing a seal between the annular spacer plate and the first fluid communicating part of the pump, the second seal providing a seal between the annular spacer plate and the second fluid communicating part of the pump, the inner peripheries of the first and second seals sealing engaging each other and isolating the inner periphery of the annular spacer plate from the fluid being pumped.

12. The pump of claim 11 wherein the spacer plate is fabricated from an injection molded material and wherein the first and second seals are fabricated from an elastomer material.

13. The pump of claim 11 wherein the inner periphery of the first seal further comprises at least one outwardly protruding lip, the lip of the first seal engaging the first fluid communicating part of the pump and providing a seal between the annular spacer plate and the first fluid communicating part of the pump, and wherein the inner periphery of the second seal further comprises an outwardly protruding lip, the lip of the second seal engaging the second fluid communicating part of the pump and providing a seal between the annular spacer plate and the second fluid communicating part of the pump, and wherein the engagement between the lip of the first seal and the first fluid communicated part and the engagement between the lip of the second seal and the second fluid communicating part causes the inner peripheries of the first and second seals to be pressed together in a sealing engagement thereby preventing fluid being communicating through the first and second fluid communicating parts from coming into contact with the annular spacer plate.

14. A combination spacer and shim assembly for attachment between first and second fluid communicating parts of a pump, the assembly comprising:

an annular spacer plate comprising an outer periphery for attachment between the two fluid communicating parts of the pump assembly, the spacer plate further comprising a first side and a second side, the spacer plate being fabricated from an injection molded material, the first side of the spacer plate comprising a first annular recessed area at an inner periphery thereof for removably accommodating a first annular seal, the second side of the spacer plate comprising a second annular recessed area at an inner periphery thereof for removably accommodating a second annular seal, the first seal providing a sealing engagement between the annular spacer plate and the first fluid communicating part of the pump, the second seal providing a sealing engagement between the annular spacer plate and the second fluid communicating part of the pump, the first and second seals being fabricated from an elastomer material, the first seal removably engaging the annular spacer plate and the first fluid communicating part, the second seal removably engaging the annular spacer plate and the second fluid communicating part, the engagement between the first seal and the first fluid communicating part and the engagement between the second seal and the second fluid communicating part prevents fluid being communicated through the first and second fluid communicating parts from coming in contact with the annular spacer plate.

* * * * *